US006790094B1

(12) United States Patent
Bergmann et al.

(10) Patent No.: US 6,790,094 B1
(45) Date of Patent: Sep. 14, 2004

(54) CONNECTOR TO COUPLE A MONITOR TO A COMPUTER

(75) Inventors: Thomas Bergmann, Berlin (DE); Thomas Meier, Berlin (DE)

(73) Assignee: Formac Elektronik GmbH (DE)

( * ) Notice: Subject to any disclaimer, the term of this patent is extended or adjusted under 35 U.S.C. 154(b) by 0 days.

(21) Appl. No.: 10/244,043

(22) Filed: Sep. 12, 2002

(51) Int. Cl.[7] ..... H01R 25/00
(52) U.S. Cl. ..... 439/653
(58) Field of Search ..... 439/638, 502, 439/623, 624, 653, 639, 955, 764

(56) References Cited

U.S. PATENT DOCUMENTS

| | | | | |
|---|---|---|---|---|
| 5,457,600 | A | * 10/1995 | Campbell et al. | 361/643 |
| 5,635,952 | A | 6/1997 | Gable | |
| 5,836,783 | A | * 11/1998 | Morisawa et al. | 439/502 |
| 5,989,060 | A | * 11/1999 | Coile et al. | 439/489 |
| 6,217,390 | B1 | 4/2001 | Casari | |
| 6,530,085 | B1 | * 3/2003 | Perlman | 725/82 |
| 6,586,849 | B2 | * 7/2003 | Tarr | 307/38 |
| 2002/0111076 | A1 | * 8/2002 | Wendt | 439/652 |
| 2003/0176109 | A1 | * 9/2003 | Fukuchi et al. | 439/638 |

FOREIGN PATENT DOCUMENTS

WO WO 01/75583 A1 10/2001

OTHER PUBLICATIONS

The Apple DVI to ADC Adapter, URL: http://www.apple-.com/displays/adapter.html, date printed: Sep. 6, 2002.
DVIator DVI to ADC Adaptor! URL: http://www.devdepot-.com/description.html?pcode=HDBDVI, date printed: Sep. 6, 2002.
The Emerging DVI Spec, URL: http://www.themeter.com/articles/DVIspec.shtml, date printed: Sep. 6, 2002.
VESA Plug and Display (P&D™) Standard, Version 1, Jun. 11, 1997.
The four best ways to see your ideas, URL: http://www.apple.com/displays/, date printed: Sep. 6, 2002.

* cited by examiner

*Primary Examiner*—J. F. Duverne
(74) *Attorney, Agent, or Firm*—Cooley Godward LLP

(57) ABSTRACT

A connector is provided to couple a monitor to a computer. The connector includes an adaptor that includes a first port and a second port. The connector also includes a cable extending through the adaptor. The cable includes a first transmission channel, a second transmission channel, and a third transmission channel. The first transmission channel couples a first end of the cable and the first port and is configured to transmit power from a power supply to the monitor. The second transmission channel couples the first end of the cable and the second port and is configured to transmit Universal Serial Bus data between the monitor and the computer. The third transmission channel couples the first end of the cable and a second end of the cable and is configured to transmission video data between the monitor and the computer.

19 Claims, 2 Drawing Sheets

CONNECTOR TO COUPLE A MONITOR TO A COMPUTER

BRIEF DESCRIPTION OF THE INVENTION

The present invention relates generally to monitors. More particularly, the present invention relates to a connector to couple a monitor to a computer.

BACKGROUND OF THE INVENTION

A monitor is typically configured to display images for a user. For certain applications, the monitor can produce images in accordance with video data received from a computer that is coupled to the monitor. To enhance its functionality, the monitor can be provided with an Universal Serial Bus (USB) port to which a keyboard or a mouse can be coupled.

Coupling of a monitor to a computer sometimes can require a number of separate cables that transmit different types of data between the monitor and the computer. For instance, coupling of the monitor to the computer can require one cable to transmit video data associated with operation of the monitor and another separate cable to transmit USB data associated with operation of a keyboard or a mouse that is coupled to the monitor. Operation of the monitor also can require a cable that couples the monitor to a power supply, such as, for example, an external power supply. Use of separate cables can complicate installation of a computer system and can reduce the workspace available to a user.

Attempts have been made to reduce the number of separate cables needed to couple a monitor to a computer. While providing some benefits, such previous attempts typically suffered from one or more shortcomings. In particular, such previous attempts often provided limited flexibility in the types of monitors and computers that can be coupled with a reduced number of separate cables. Also, for some previous attempts, video data is transmitted between a monitor and a computer via one or more intermediate connections, which can introduce distortions to the transmitted video data and impair the quality of the resulting image. And, some previous attempts do not provide transmission of audio data to a monitor for operation of, for example, a microphone or a speaker that is coupled to the monitor.

It is against this background that a need arose to develop the apparatus described herein.

SUMMARY OF THE INVENTION

In one innovative aspect, the present invention relates to a connector to couple a monitor to a computer. In one embodiment, the connector comprises an adaptor. The adaptor includes a first port and a second port. The first port is configured to couple the adaptor to a power supply, and the second port is configured to couple the adaptor to the computer. The connector also comprises a cable extending through the adaptor. The cable includes a first end, a second end, and an intermediate portion located between the first end and the second end. The first end is configured to couple the cable to the monitor, and the second end is configured to couple the cable to the computer. The intermediate portion includes a first transmission channel, a second transmission channel, and a third transmission channel. The first transmission channel couples the first end to the first port and is configured to transmit power from the power supply to the monitor. The second transmission channel couples the first end to the second port and is configured to transmit Universal Serial Bus (USB) data between the monitor and the computer. The third transmission channel couples the first end to the second end and is configured to transmit video data between the monitor and the computer.

In another embodiment, the connector comprises an adaptor. The adaptor includes a first port, a second port, and a third port. The first port is configured to couple the adaptor to a power supply, the second port is configured to couple the adaptor to an Universal Serial Bus (USB) port of the computer, and the third port is configured to couple the adaptor to an audio port of the computer. The connector also comprises a cable coupled to the adaptor. The cable includes a first end, a second end, and an intermediate portion located between the first end and the second end. The first end is configured to couple the cable to the monitor, and the second end is configured to couple the cable to a video port of the computer. The intermediate portion includes a first transmission channel, a second transmission channel, a third transmission channel, and a fourth transmission channel. The first transmission channel couples the first end to the first port and is configured to transmit power from the power supply to the monitor. The second transmission channel couples the first end to the second port and is configured to transmit USB data between the monitor and the computer. The third transmission channel couples the first end to the third port and is configured to transmit audio data between the monitor and the computer. The fourth transmission channel couples the first end to the second end and is configured to transmit video data between the monitor and the computer.

In a further embodiment, the connector comprises an adaptor. The adaptor includes a first port, and the first port is configured to couple the adaptor to a power supply. The connector also comprises a cable extending through the adaptor. The cable includes a first end, a second end, and an intermediate portion located between the first end and the second end. The first end is configured to couple the cable to the monitor, and the second end is configured to couple the cable to the computer. The intermediate portion includes a first transmission channel, a second transmission channel, and a third transmission channel. The first transmission channel couples the first end to the first port and is configured to transmit power from the power supply to the monitor. The second transmission channel couples the first end to the second end and is configured to transmit Universal Serial Bus (USB) data between the monitor and the computer. The third transmission channel couples the first end to the second end and is configured to transmit video data between the monitor and the computer.

BRIEF DESCRIPTION OF THE DRAWINGS

For a better understanding of the nature and objects of the present invention, reference should be made to the following detailed description taken in conjunction with the accompanying drawings, in which.

DETAILED DESCRIPTION

Figure 1:
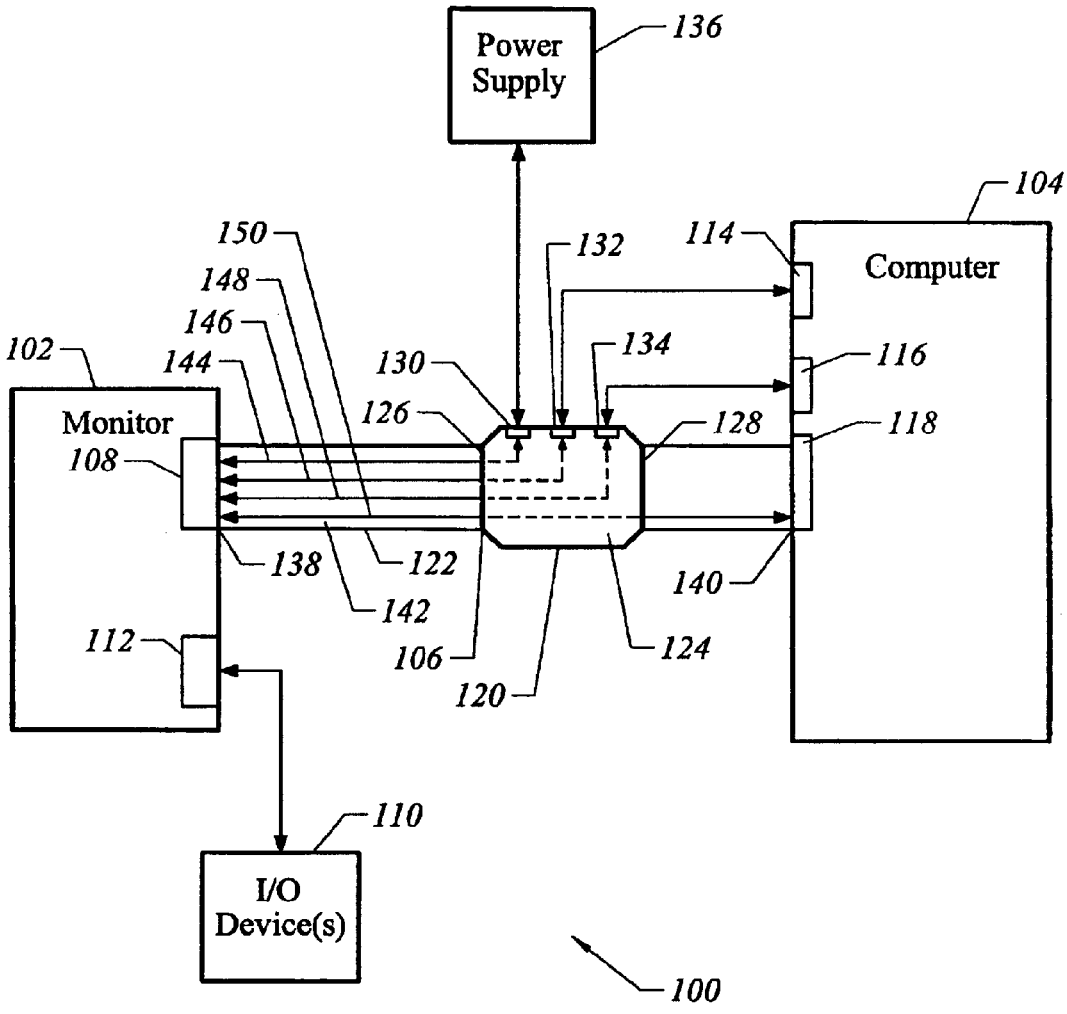
FIG. 1 illustrates a computer system that can. be operated in accordance with an embodiment of the invention.

FIG. 1 illustrates a computer system 100 that can be operated in accordance with an embodiment of the invention. The computer system 100 includes a monitor 102 and a computer 104. The monitor 102 and the computer 104 are coupled by a connector 106 as further described herein.

The monitor 102 is configured to display images in accordance with video data received from the computer 104. Examples of the monitor 102 include Cathode Ray Tube (CRT) monitors, Liquid Crystal Display (LCD) monitors, and Thin Film Transistor (TFT) monitors. As shown in FIG. 1, the monitor 102 includes a port 108 that is configured to receive video data from the computer 104. In the present embodiment of the invention, the port 108 is also configured to receive power for operation of the monitor 102. And, the port 108 is configured to receive or transmit other types of data, including, for example, audio data and USB data. These other types of data can be associated with operation of a set of Input/Output (I/O) devices 110 that is coupled to the monitor 102. The set of I/O devices 110 can include, for example, a keyboard, a microphone, a mouse, a printer, a scanner, a speaker, and so forth. As shown in FIG. 1, the set of I/O devices 110 is coupled to the monitor 102 via a port 112. For example, the set of I/O devices 110 can include a keyboard or a mouse, and the port 112 can include an USB port to couple the keyboard or the mouse to the monitor 102.

The computer 104 is configured to direct operation of the monitor 102 and the set of I/O devices 110 that is coupled to the monitor 102. The computer 104 can be a general purpose computer and can include conventional components such as, for example, an audio card, a central processing unit, a memory, a video card, and so forth. Examples of the computer 104 include desktop computers, laptop computers, and handheld computers.

As shown in FIG. 1, the computer 104 includes various ports 114, 116, and 118, which, in the present embodiment of the invention, correspond to an USB port, an audio port, and a video port, respectively. The port 116 can be associated with an audio card of the computer 104, and the port 118 can be associated with a video card of the computer 104. In addition to receiving or transmitting video data, the port 118 of some embodiments of the invention also can be configured to transmit power for operation of the monitor 102 as well as receive or transmit other types of data, including, for example, USB data. These other types of data can be associated with operation of the set of I/O devices 110 that is coupled to the monitor 102. While three ports 114, 116, and 118 are shown in FIG. 1, it should be recognized that the computer 104 can include more or less ports depending on the specific application.

In the present embodiment of the invention, the monitor 102 and the computer 104 are coupled by the connector 106. The connector 106 is configured to transmit power to the monitor 102 as well as allow communication between the monitor 102 and the computer 104. By appropriately configuring the connector 106 as discussed herein, various types of monitors and computers can be coupled.

As shown in FIG. 1, the connector 106 includes an adapter 120 and a cable 122. The adaptor 120 includes a body portion 124 that has a first opening 126 and a second opening 128. In the present embodiment of the invention, the adaptor 120 also includes various ports 130, 132, and 134 that are coupled to the body portion 124. While three ports 130, 132, and 134 are shown in FIG. 1, it should be recognized that the adaptor 120 can include more or less ports depending on the specific application.

As shown in FIG. 1, the port 130 is configured to couple the adaptor 120 to a power supply 136, which, in the present embodiment of the invention, is an external power supply. The power supply 136 can include an Alternating Current/Direct Current (AC/DC) converter to supply DC power for operation of the monitor 102 and can be coupled to the port 130 via any wire or wireless connection. The port 132 is configured to couple the adaptor 120 to the port 114 of the computer 104 via any wire or wireless connection. And, the port 134 is configured to couple the adaptor 120 to the port 116 of the computer 104 via any wire or wireless connection.

The connector 106 also includes the cable 122 that is coupled to the adaptor 120. As shown in FIG. 1, the cable 122 is formed as a single cable coupling the monitor 102 to the computer 104. The cable 122 includes a first end 138 and a second end 140. The first end 138 is configured to couple the cable 122 to the monitor 102, while the second end 140 is configured to couple the cable 122 to the port 118 of the computer 104.

The cable 122 also includes an intermediate portion 142 located between the first end 138 and the second end 140. The intermediate portion 142 includes various transmission channels 144, 146, 148, and 150. As shown in FIG. 1, the transmission channels 144, 146, 148, and 150 are combined to form the intermediate portion 142. While four transmission channels 144, 146, 148, and 150 are shown in FIG. 1, it should be recognized that the cable 122 can include more or less transmission channels depending on the specific application.

As shown in FIG. 1, the transmission channel 144 couples the first end 138 of the cable 122 to the port 130 of the adaptor 120 and is configured to transmit power from the power supply 136 to the monitor 102. The transmission channel 146 couples the first end 138 of the cable 122 to the port 132 of the adaptor 120 and is configured to transmit USB data between the monitor 102 and the computer 104. The transmission channel 148 couples the first end 138 of the cable 122 to the port 134 of the adaptor 120 and is configured to transmit audio data between the monitor 102 and the computer 104. And, the transmission channel 150 couples the first end 138 to the second end 140 of the cable 122 and is configured to transmit video data between the monitor 102 and the computer 104. In the present embodiment of the invention, the transmission channel 150 extends through the openings 126 and 128 of the adaptor 120. More particularly, the transmission channel 150 of the present embodiment of the invention extends through the openings 126 and 128 without requiring intermediate connections to or within the adaptor 120 (e.g., without requiring intermediate links or soldering to join discrete portions of the transmission channel 150). Such configuration is particularly desirable to reduce distortions to transmitted video data typically introduced by the presence of intermediate connections, which distortions can impair the quality of images displayed by the monitor 102.

For some embodiments of the invention, the port 118 of the computer 104 also can be configured to transmit power for operation of the monitor 102 as well as receive or transmit other types of data associated with operation of the set of I/O devices 110 that is coupled to the monitor 102. For such embodiments, one or more of the transmission channels 144, 146, and 148 can be coupled to the second end 140 of the cable 122 in a similar manner as discussed for the transmission channel 150.

The foregoing discussion provides a general overview of the components and operation of one embodiment of the invention. Attention now turns to FIG. 2, which illustrates a connector 200 to couple a monitor (e.g., the monitor 102) to a computer (e.g., the computer 104) in accordance with another embodiment of the invention.

Figure 2:
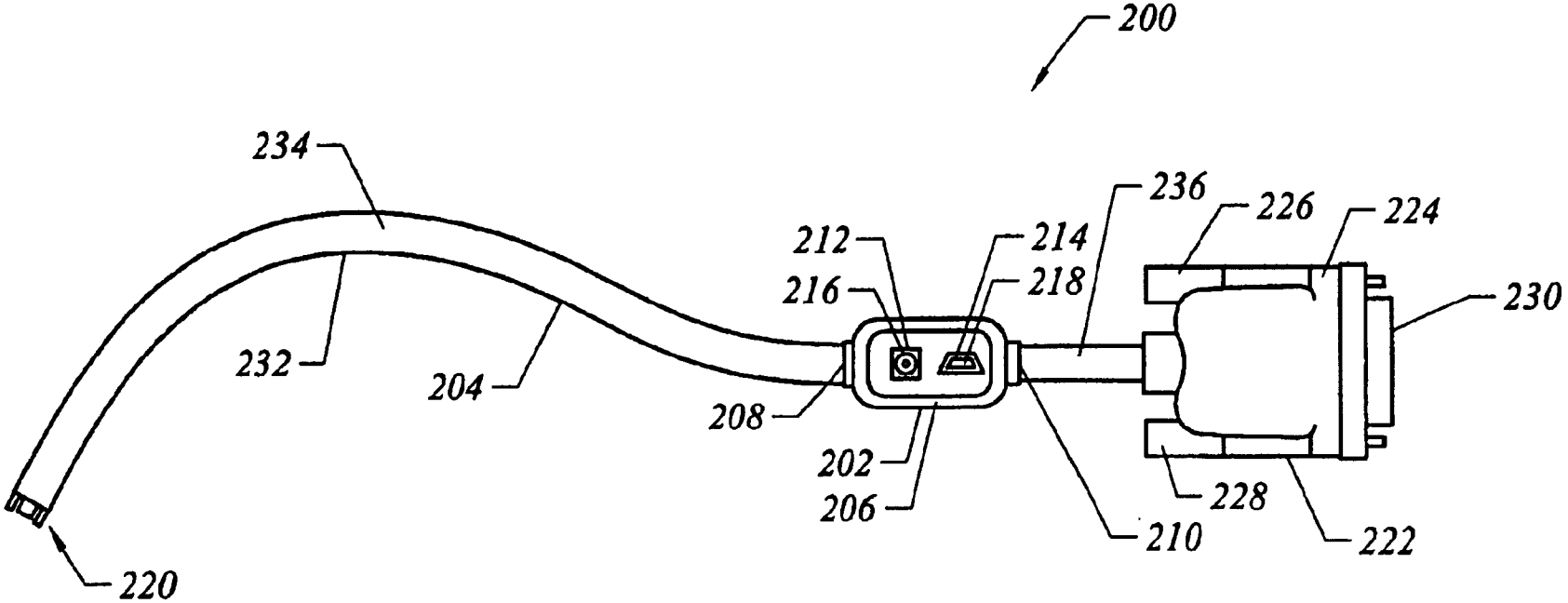
FIG. 2 illustrates a connector to couple a monitor to a computer in accordance with another embodiment of the invention.

As shown in FIG. 2, the connector 200 includes an adapter 202 and a cable 204. The adaptor 202 includes a body portion 206 that has various openings 208, 210, 212, and 214. In the present embodiment of the invention, the cable 204 extends through the adaptor 202 via the openings 208 and 210. As shown in FIG. 2, the adaptor 202 also includes ports 216 and 218, which are operably disposed in the openings 212 and 214, respectively. In the present embodiment of the invention, the port 216 is configured to couple the adaptor 202 to an external power supply via a conventional cable, while the port 218 is configured to couple the adaptor 202 to an USB port of the computer via a conventional cable.

The cable 204 includes a first end 220 and a second end 222. The first end 220 is configured to couple the cable 204 to the monitor. In particular, the first end 226 of the present embodiment of the invention is configured to couple the cable 204 to an Apple Display Connector (ADC) port of the monitor. The second end 222 is configured to couple the cable 204 to a port associated with a video card of the computer. In particular, the second end 222 of the present embodiment of the invention is configured to couple the cable 204 to a Digital Visual Interface (DVI) port of the video card. As shown in FIG. 2, the second end 222 includes a DVI coupler 224. The DVI coupler 224 includes a set of pins 230 that interfaces with a corresponding set of depressions of the DVI port of the video card. The DVI coupler 224 also includes thumbscrews 226 and 228 that allow the DVI coupler 224 to be secured to the DVI port of the video card. Alternatively, or in conjunction, the second end 222 can be configured to couple the cable 204 to an ADC port or a Video Graphics Array (VGA) port associated with the video card. Thus, by appropriately configuring the second end 222, the connector 200 allows the monitor to be coupled to a variety of ports that can be associated with the video card.

As shown in FIG. 2, the cable 204 also includes an intermediate portion 232 located between the first end 220 and the second end 222. A section (e.g., an exposed section) of the intermediate portion 232 can include an outer sheath or tube. With reference to FIG. 2, outer sheaths 234 and 236 are shown for two different sections of the intermediate portion 232.

In the present embodiment of the invention, the intermediate portion 232 includes various transmission channels (not shown in FIG. 2) that are coupled to the first end 220 of the cable 204. In particular, a first transmission channel can include a set of conventional cables that couples the first end 220 of the cable 204 to the port 216 of the adaptor 202 to transmit power from the external power supply to the monitor. In the present embodiment of the invention, the first transmission channel can include a pair of cables, one of which supplies a ground voltage, and the other supplies a voltage between approximately +12V and +18V. A second transmission channel can include a set of conventional cables that couples the first end 220 of the cable 204 to the port 218 of the adaptor 202 to transmit USB data between the monitor and the computer. In the present embodiment of the invention, the second transmission channel can include a pair of USB cables connecting the first end 220 of the cable 204 to the port 218 of the adaptor 202. A third transmission channel can include a set of conventional cables that extends through the openings 208 and 210 of the adaptor 202 and couples the first end 220 to the second end 222 of the cable 204 to transmit video data between the monitor and the computer. Depending on the particular video card and the particular monitor used, video data that is transmitted between the monitor and the computer can be analog video data, digital video data, or a combination thereof. In the present embodiment of the invention, digital video data is transmitted in accordance with Transition Minimized Differential Signaling (TMDS) using three pairs of cables. Depending on the specific application, the third transmission channel also can include cables that transmit clock signals as well as configuration data associated with operation of the monitor.

At this point, one of ordinary skill in the art will understand advantages associated with various embodiments of the invention. In particular, some embodiments of the invention simplify coupling of a monitor to a computer while enhancing the workspace available to a user. Also, some embodiments of the invention provide greater flexibility in the types of monitors and computers that can be coupled. For example, embodiments of the invention allow a monitor to be coupled to a variety of ports that can be associated with a video card of a computer. As another example, embodiments of the invention allow use of a desirable monitor by providing power required by the monitor from a power supply. In addition, some embodiments of a connector includes a transmission channel that transmits video data between a monitor and a computer without requiring intermediate connections that can introduce distortions to the transmitted video data. And, some embodiments of a connector includes a transmission channel that transmits audio data for operation of, for example, a microphone or a speaker that is coupled to a monitor.

It should be recognized that the specific embodiments of the invention discussed above are merely exemplary, and various other embodiments are encompassed by the present invention. For example, some embodiments of the invention relate to a monitor that is coupled to or formed integrally with a connector as discussed herein. As another example, some embodiments of the invention relate to a computer system that includes a connector as discussed herein. As a further example, some embodiments of the invention relate to a method of operating a computer system that includes a connector as discussed herein.

While the present invention has been described with reference to the specific embodiments thereof, it should be understood by those skilled in the art that various changes may be made and equivalents may be substituted without departing from the true spirit and scope of the invention as defined by the appended claims. In addition, many modifications may be made to adapt a particular situation, material, composition of matter, method, process step or steps, to the objective, spirit and scope of the present invention. All such modifications are intended to be within the scope of the claims appended hereto. In particular, while the methods disclosed herein have been described with reference to particular steps performed in a particular order, it will be understood that these steps may be combined, sub-divided, or re-ordered to form an equivalent method without departing from the teachings of the present invention. Accordingly, unless specifically indicated herein, the order and grouping of the steps is not a limitation of the present invention.

What is claimed is:

1. A connector to couple a monitor to a computer, comprising:

an adaptor, said adaptor including a first port and a second port, said first port being configured to couple said adaptor to a power supply, said second port being configured to couple said adaptor to said computer; and a cable extending through said adaptor, said cable including a first end, a second end, and an intermediate portion located between said first end and said second end, said first end being configured to couple said cable to said monitor, said second end being configured to couple said cable to said computer, said intermediate portion including a first transmission channel, a second transmission channel, and a third transmission channel, said first transmission channel coupling said first end to said first port and being configured to transmit power from said power supply to said monitor, said second transmission channel coupling said first end to said second port and being configured to transmit Universal Serial Bus (USB) data between said monitor and said computer, said third transmission channel coupling said first end to said second end and being configured to transmit video data between said monitor and said computer.

2. The connector of claim 1, wherein said second port is configured to couple said adaptor to an USB port of said computer.

3. The connector of claim 1, wherein said adaptor includes a body portion defining a first opening and a second opening, said third transmission channel extending through said first opening and said second opening, said first port and said second port being coupled to said body portion.

4. The connector of claim 1, wherein said third transmission channel is configured to transmit digital video data between said monitor and said computer.

5. The connector of claim 1, wherein said third transmission channel is configured to transmit analog video data between said monitor and said computer.

6. The connector of claim 1, wherein said second end is configured to couple said cable to a video port of said computer.

7. The connector of claim 1, wherein said second end is configured to couple said cable to a Digital Visual Interface port of said computer.

8. The connector of claim 1, wherein said second end is configured to couple said cable to a Video Graphics Array port of said computer.

9. A connector to couple a monitor to a computer, comprising:

an adaptor, said adaptor including a first port, a second port, and a third port, said first port being configured to couple said adaptor to a power supply, said second port being configured to couple said adaptor to an Universal Serial Bus (USB) port of said computer, said third port being configured to couple said adaptor to an audio port of said computer; and a cable coupled to said adaptor, said cable including a first end, a second end, and an intermediate portion located between said first end and said second end, said first end being configured to couple said cable to said monitor, said second end being configured to couple said cable to a video port of said computer, said intermediate portion including a first transmission channel, a second transmission channel, a third transmission channel, and a fourth transmission channel, said first transmission channel coupling said first end to said first port and being configured to transmit power from said power supply to said monitor, said second transmission channel coupling said first end to said second port and being configured to transmit USB data between said monitor and said computer, said third transmission channel coupling said first end to said third port and being configured to transmit audio data between said monitor and said computer, said fourth transmission channel coupling said first end to said second end and being configured to transmit video data between said monitor and said computer.

10. The connector of claim 9, wherein said fourth transmission channel extends through said adaptor.

11. The connector of claim 9, wherein said fourth transmission channel is configured to transmit digital video data between said monitor and said computer.

12. The connector of claim 9, wherein said fourth transmission channel is configured to transmit analog video data between said monitor and said computer.

13. A connector to couple a monitor to a computer, comprising:

an adaptor, said adaptor including a first port, said first port being configured to couple said adaptor to a power supply; and a cable extending through said adaptor, said cable including a first end, a second end, and an intermediate portion located between said first end and said second end, said first end being configured to couple said cable to said monitor, said second end being configured to couple said cable to said computer, said intermediate portion including a first transmission channel, a second transmission channel, and a third transmission channel, said first transmission channel coupling said first end to said first port and being configured to transmit power from said power supply to said monitor, said second transmission channel coupling said first end to said second end and being configured to transmit Universal Serial Bus (USB) data between said monitor and said computer, said third transmission channel coupling said first end to said second end and being configured to transmit video data between said monitor and said computer.

14. The connector of claim 13, wherein said adaptor includes a body portion defining a first opening and a second opening, said second transmission channel and said third transmission channel extending through said first opening and said second opening, said first port being coupled to said body portion.

15. The connector of claim 13, wherein said adaptor further includes a second port, said second port being configured to couple said adaptor to said computer, said intermediate portion further including a fourth transmission channel, said fourth transmission channel coupling said first end to said second port and being configured to transmit audio data between said monitor and said computer.

16. The connector of claim 15, wherein said second port is configured to couple said adaptor to an audio port of said computer.

17. The connector of claim 1, wherein said adaptor includes a body portion defining a first opening and a second opening, said cable extending through said adaptor via said first opening and said second opening, said first port and said second port being coupled to said body portion.

18. The connector of claim 9, wherein said cable extends through said adaptor.

19. The connector of claim 13, wherein said intermediate portion includes a sheath surrounding at least a portion of said first transmission channel, said second transmission channel, and said third transmission channel.

* * * * *